US010893361B2

(12) United States Patent
Chapman et al.

(10) Patent No.: US 10,893,361 B2
(45) Date of Patent: Jan. 12, 2021

(54) LOW FREQUENCY SOUND FIELD IN A LISTENING ENVIRONMENT

(71) Applicant: Harman Becker Automotive Systems GmbH, Karlsbad (DE)

(72) Inventors: Peter John Chapman, Lemvig (DK); Martin Olsen, Struer (DK)

(73) Assignee: HARMAN BECKER AUTOMOTIVE SYSTEMS GMBH, Karlsbad (DE)

( * ) Notice: Subject to any disclaimer, the term of this patent is extended or adjusted under 35 U.S.C. 154(b) by 0 days.

(21) Appl. No.: 16/239,143

(22) Filed: Jan. 3, 2019

(65) Prior Publication Data

US 2019/0208322 A1 Jul. 4, 2019

Related U.S. Application Data

(60) Provisional application No. 62/613,731, filed on Jan. 4, 2018.

(51) Int. Cl.

| | |
|---|---|
| ***H04R 3/04*** | (2006.01) |
| ***H04R 1/26*** | (2006.01) |
| ***H04R 3/12*** | (2006.01) |
| ***H04R 3/14*** | (2006.01) |
| ***H04R 1/02*** | (2006.01) |

(Continued)

(52) U.S. Cl.

CPC ..... *H04R 3/04* (2013.01); *H04R 1/025* (2013.01); *H04R 1/26* (2013.01); *H04R 3/12* (2013.01); *H04R 3/14* (2013.01); *H04S 7/301* (2013.01); *H04S 7/307* (2013.01); *H04R 2499/13* (2013.01)

(58) Field of Classification Search

CPC ..... H04R 1/025; H04R 1/26; H04R 2499/13; H04R 3/04; H04R 3/12; H04R 3/14; H04S 7/301; H04S 7/307

USPC ..... 381/27, 59, 86, 98, 99, 103, 350, 398

See application file for complete search history.

(56) References Cited

U.S. PATENT DOCUMENTS 4,905,284 A * 2/1990 Kwang ..... H04R 3/14 381/100

5,124,668 A * 6/1992 Christian ..... H03G 7/08 330/302

(Continued)

FOREIGN PATENT DOCUMENTS

GB 2541639 A 3/2017

OTHER PUBLICATIONS

Christian Sejer Pedersen, Henrik Møller and Kerstin Persson Waye, A Detailed Study of Low-Frequency Noise Complaints, 2008, Journal of Low Frequency Noise, Vibration and Active Control, vol. 27, p. 7.*

(Continued)

*Primary Examiner* — Vivian C Chin
*Assistant Examiner* — Friedrich Fahnert
(74) *Attorney, Agent, or Firm* — McCoy Russell LLP

(57) ABSTRACT

The present disclosure provides methods and systems for homogenizing a low frequency listening experience for users in a plurality of locations, such as a plurality of seat positions in a vehicle. An example audio system includes a plurality of woofers configured to output low frequency sound into a listening environment to yield a homogeneous low frequency sound field. Homogeneity of the low frequency sound field in this case is for example spectrally uniform throughout an extended listening space.

20 Claims, 13 Drawing Sheets

(51) Int. Cl.
*H04S 7/00* (2006.01)
*H04R 7/00* (2006.01)

(56) References Cited

U.S. PATENT DOCUMENTS

| | | | | |
|---|---|---|---|---|
| 5,754,663 | A * | 5/1998 | Goldfarb | H04R 5/02 381/182 |
| 9,668,081 | B1 * | 5/2017 | Chen | H04S 7/307 |
| 9,820,032 | B1 * | 11/2017 | Zhang | H04R 1/2865 |
| 10,158,960 | B1 * | 12/2018 | Moller | H04S 7/301 |
| 2004/0202343 | A1 * | 10/2004 | Rye | H04R 1/2842 381/353 |
| 2007/0025559 | A1 | 2/2007 | Mihelich et al. | |
| 2008/0049948 | A1 * | 2/2008 | Christoph | H04S 7/301 381/86 |
| 2010/0290643 | A1 * | 11/2010 | Mihelich | H04S 7/301 381/99 |
| 2013/0039512 | A1 * | 2/2013 | Miyata | H04R 3/12 381/97 |
| 2013/0322635 | A1 * | 12/2013 | Ma | H04R 1/403 381/17 |
| 2014/0119570 | A1 * | 5/2014 | Davis | H04R 3/12 381/103 |
| 2014/0153744 | A1 * | 6/2014 | Brannmark | H04R 3/04 381/103 |
| 2014/0314256 | A1 * | 10/2014 | Fincham | H04R 3/12 381/303 |
| 2014/0334638 | A1 * | 11/2014 | Barksdale | H04R 3/12 381/86 |
| 2016/0277833 | A1 * | 9/2016 | Qin | H04R 3/04 |
| 2017/0213541 | A1 * | 7/2017 | MacNeille | G06F 3/165 |
| 2018/0007466 | A1 * | 1/2018 | Hess | H04R 1/26 |
| 2018/0324508 | A1 * | 11/2018 | Hudson, III | H04R 1/025 |

OTHER PUBLICATIONS

European Patent Office, Extended European Search Report Issued in Application No. 19150166.7, dated Mar. 4, 2019, Germany, 8 pages.

* cited by examiner

800

1200

LOW FREQUENCY SOUND FIELD IN A LISTENING ENVIRONMENT

CROSS REFERENCE TO RELATED APPLICATIONS

The present application claims priority to U.S. Provisional Application No. 62/613,731, entitled "LOW FREQUENCY SOUND FIELD IN A LISTENING ENVIRONMENT", and filed on Jan. 4, 2018. The entire contents of the above-listed application are hereby incorporated by reference for all purposes.

TECHNICAL FIELD

Embodiments disclosed herein generally relate to audio systems having low frequency transducers for controlling low frequency sound fields in listening environments.

BACKGROUND

A conventional vehicle includes a listening environment. Inside of the listening environment, there may be several seats, such as a driver seat, a front passenger seat, a first rear seat, a second rear seat, etc. The conventional vehicle may further include an audio system having a low frequency loudspeaker. The single low frequency loudspeaker may be responsible for outputting some or all of the low frequency sound into the listening environment. Because of the single low frequency loudspeaker, the low frequency sound field in the listening environment will significantly vary seat to seat. Thus an occupant's low frequency listening experience will vary significantly depending on seat choice.

SUMMARY

The present disclosure provides methods and systems for homogenizing a low frequency listening experience for users in a plurality of locations, such as a plurality of seat positions in a vehicle. An example audio system includes a plurality of woofers configured to output low frequency sound into a listening environment to yield a homogeneous low frequency sound field in specified listening regions (e.g., regions where acoustic transfer functions are estimated and/or measured). The example audio system may further include a plurality of filters, each of the plurality of woofers having a respective filter of the plurality of filters assigned thereto to yield the homogeneous low frequency sound field. Homogeneity of the low frequency sound field in this case is for example spectrally uniform across the extended listening region or regions.

As described herein, a resulting homogenous sound field is a consequence of sound field control filters (e.g., applied to low frequency loudspeakers) that are calculated based on acoustic transfer functions from each individual low frequency loudspeaker to each point in space defining the controlled listening region(s) of concern. The filters may be determined based on constrained optimization with a specified cost function realizing a given target or set of targets (e.g., least mean square with various constraints defined such as degree of homogeneity, control loudspeaker effort or power used to realize the target, etc.). When each respective filter is applied to each respective low frequency loudspeaker, the resulting combined sound field ideally realizes the target(s) and hence creates a homogeneous low frequency sound field inside the spatial listening region(s) of concern. Accordingly, the filters are calculated and applied to the respective low frequency loudspeakers in order to control the resulting combined sound field of the low frequency loudspeakers.

An example method for producing a homogeneous low frequency sound field via a plurality of woofers of an audio system includes setting, with a processor of the audio system, a target low frequency sound field performance for the homogeneous low frequency sound field, defining, with the processor, a listening area for the homogeneous low frequency sound field, and selecting, with the processor, the plurality of woofers to output the homogeneous low frequency sound field, each of the plurality of woofers having a respective position specified relative to an environment including the listening area. The example method may further include calculating filters, with the processor, that can create the homogeneous low frequency sound field, applying one or more filters to a low frequency signal supplied to the plurality of woofers, the one or more filters being tuned based on the predicted or targeted homogeneous low frequency sound field, and outputting, via the plurality of woofers, individual contributions to the sound field that by superposition, create the homogeneous low frequency sound field.

The overall achievable performance and thus homogeneity of the low frequency sound field will depend on the spatial diversity of positions of the plurality of woofers in relation to the listening regions where homogeneity is desired. For example, a reduced spatial diversity of the plurality of woofers will reduce the achievable uniformity. In order to characterize the sound field inside of the listening environment, an initial setup may include estimating or measuring acoustic transfer functions from each individual loudspeaker to different points in space in the listening environment. The estimation and/or measurement of acoustic transfer functions may include performing simulations (e.g., using estimations or measurements of geometries of the listening environment and/or prior data regarding similar environments) and/or using microphones/microphone arrays to measure sound propagation in the environment.

An example audio system for a vehicle includes a plurality of woofers, one or more non-woofer transducers, a low frequency crossover, and a controller configured to receive target parameters for a homogeneous low frequency sound field, define a listening area for the homogeneous low frequency sound field within the vehicle, and calculate the homogeneous low frequency sound field based on the received target parameters and the defined listening area. The controller may be further configured to receive an audio signal from an audio source, direct the audio signal to the low frequency crossover, the low frequency crossover configured to split the audio signal into a first signal corresponding to a first frequency range of the audio signal and a second signal corresponding to a second frequency range of the audio signal, the first frequency range being lower than the second frequency range, and direct the first signal to each of the plurality of woofers and the second signal to at least one transducer of the one or more non-woofer transducers. The controller may be further configured to, for each woofer, apply a respective filter to the first signal to generate a respective filtered signal, the respective filter being tuned based on the calculated homogeneous low frequency sound field, and output, via the plurality of woofers, each respective filtered signal to generate the homogeneous low frequency sound field.

DETAILED DESCRIPTION

Detailed embodiments are disclosed herein; however, it is to be understood that the disclosed embodiments are merely exemplary of the disclosed features that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis.

As used herein, spatial properties of a resulting sound field reproduced by a sound system may refer to how a signal is measured or perceived across a spatially confined region defining listening positions of concern. A homogenous low frequency sound field may be defined as having low spatial deviation among the listening positions inside a target region, with targets related to spectral and temporal details and targets, as will be described below, realized across the entire spatial target region. Spectral properties of a resulting sound field may refer to the spectral density of the sound signal (e.g., the frequency response) measured or perceived (related to the timbre of the sound system) at a given point in space, as a result of control frequency impulse response filters and global tuning of the sound system (e.g., global referring to tuning filters that are common for all of the low frequency loudspeaker/woofer channels and hence will not affect the sound field control potential if global filters are of reasonable nature). Homogeneous spectral solutions may refer to a spectrally flat response, or to a spectral profile that is in accordance with a target curve (e.g., a non-flat curve). Temporal properties may refer to the time response of the system measured (e.g., impulse response) and may relate to the perception of dryness, rumbling, etc. in the bass sound reproduction. A pre-defined temporal profile according to a target time response or pre-/post-ringing shaping may be introduced to a sound system in accordance with the present disclosure.

Figure 1:
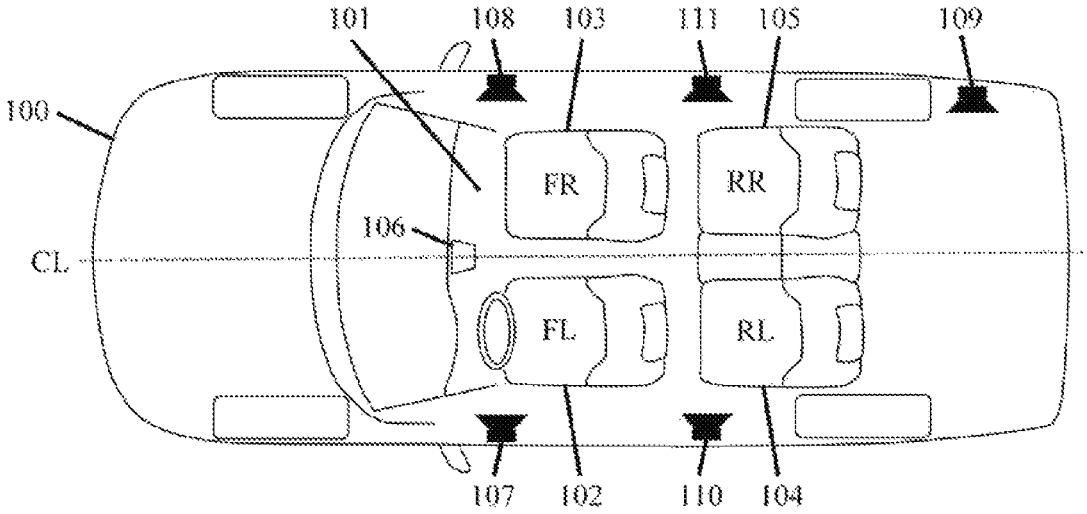
FIG. 1 illustrates a schematic diagram of a vehicle according to one or more embodiments.

FIG. 1 illustrates a schematic diagram of a vehicle 100 according to one or more embodiments. The vehicle includes a listening environment or space within the vehicle 101. Inside of the listening environment 101, the vehicle includes a plurality of seats. The plurality of seats at least includes a first seat 102 and a second seat 103. Beyond the first seat 102 and the second seat 103, the plurality of seats may include additional seats, such as a third seat 104 and a fourth seat 105.

In the vehicle 100, the first seat 102 may be a front left FL seat. When the vehicle 100 is a left-hand drive vehicle, the front left FL seat may be a driver seat. The second seat 103 may be a front right FR seat that is adjacent to the first seat 102. When the vehicle 100 is a left-hand drive vehicle, the front right FR seat may be a front passenger seat. The first seat 102 and the second seat 103 may be in a first row of the vehicle 100. The third seat 104 may be a rear left RL seat located behind the first seat 102. The fourth seat 105 may be a rear right RR seat located behind the second seat 103 and adjacent to the third seat 104. The third seat 104 and the fourth seat 105 may be in a second row of the vehicle 100.

The vehicle may include an audio system 106 for the listening environment 101. The audio system 106 may include a plurality of woofers. The plurality of woofers may include a first woofer 107, a second woofer 108, and a third woofer 109. Beyond the first, second, and third woofers 107, 108, 109, the plurality of woofers may include additional woofers, such as a fourth woofer 110 and a fifth woofer 111.

The first woofer 107 and the second woofer 108 may be located in the first row of the vehicle 100. In the first row, the first woofer 107 may be proximal to first seat 102 and distal to the second seat 103, and the second woofer 108 may be proximal to the second seat 103 and distal to the first seat 102.

The first woofer 107 may be located in a front left door of the vehicle 100. Alternatively, the first woofer 107 may be located in another area left of a center line CL of the vehicle 100. Locating the first woofer 107 in another area outside of the front left door may improve an occupant's low frequency listening experience, for this may reduce unwanted structural vibrations, which may otherwise occur when the first woofer 107 is placed in the front left door. As an example of placement in another area, when the vehicle 100 includes a center tunnel aligned on the center line CL, the first woofer 107 may be located in the center tunnel to the left of the center line CL. As another example, the first woofer 107 may be located in a firewall of the vehicle 100, where the placement is to the left of the center line CL. As another example, the first woofer 107 may be located under the first seat 102. The sound field control potential is related to the spatial diversity and/or scattering in the woofer layout. For example, woofers located in close proximity to one another or clustered together may reduce the potential for producing a homogeneous low frequency sound field.

The second woofer 108 may be located in a front right door of the vehicle 100. Alternatively, the second woofer 108 may be located in another area right of a center line CL of the vehicle 100. Like the first woofer 107, locating the second woofer 108 in another area outside of the front right door may improve the occupant's low frequency listening experience, for similar reasons. As an example of placement in another area, when the vehicle 100 includes the center tunnel aligned on the center line CL, the second woofer 108 may be located in the center tunnel to the right of the center line CL. As another example, the second woofer 108 may be located in the firewall of the vehicle 100, where the placement is to the right of the center line CL. As another example, the second woofer 108 may be located under the second seat 103.

The center line CL of the vehicle 100 may serve as a mirror line for the first woofer 107 and the second woofer 108. As such, the first woofer 107 may mirror the second woofer 108 via the center line CL. Thus the orientation of the first woofer 107 may mirror the orientation of the second woofer 108 via the center line CL.

In the vehicle, the third woofer 109 may be located in the rear of the vehicle 100, such that the third woofer is proximal to the rear of the vehicle 100 and distal to the front of the vehicle 100. For example, when the vehicle 100 includes a rear trunk, the third woofer 109 may be located therein. As another example, when the vehicle 100 includes a rear deck, the third woofer 109 may be located thereon. As another example, the third woofer 109 may be located behind the third seat 104 and the fourth seat 105, such as in a rear back support pan for the third and the fourth seats 104, 105. The third woofer 109 may be located on the center line CL of the vehicle 100.

The fourth woofer 110 and the fifth woofer 111 may be located in the second row of the vehicle 100. In the second row, the fourth woofer 110 may be proximal to third seat 104 and distal to the fourth seat 105, and the fifth woofer 111 may be proximal to the fourth seat 105 and distal to the third seat 104.

The fourth woofer 110 may be located in a rear left interior wall of the vehicle 100, which may connect to a rear left quarter panel of the vehicle 100. As another example, the fourth woofer 110 may be located in a rear left door of the vehicle 100. As another example, the fourth woofer 110 may be located under the third seat 104. As another example, the fourth woofer may be located in another area to the left of the center line CL. Like the first woofer 107, locating the fourth woofer 110 in another area outside of the rear left door may improve the occupant's low frequency listening experience, for similar reasons.

The fifth woofer 111 may be located in a rear right interior wall of the vehicle 100, which may connect to a rear right quarter panel of the vehicle 100. As another example, the fifth woofer 111 may be located in a rear right door of the vehicle 100. As another example, the fifth woofer 111 may be located under the fourth seat 105. As another example, the fifth woofer may be located in another area to the right of the center line CL. Like the first woofer 107, locating the fifth woofer 111 in another area outside of the rear right door may improve the occupant's low frequency listening experience, for similar reasons.

The center line CL of the vehicle 100 may also serve as a mirror line for the fourth woofer 110 and the fifth woofer 111. As such, the fourth woofer 110 may mirror the fifth woofer 111 via the center line CL. Thus the orientation of the fourth woofer 110 may mirror the orientation of the fifth woofer 111 via the center line CL.

The first, second, third, fourth, and fifth woofers 107, 108, 109, 110, 111, as well as any additional woofers in the plurality of woofers, may be of the same make, model, size, and thus have the same acoustical parameters, such as for frequency response, and beneficially have overlapping characteristics. Each woofer in the plurality of woofers may output into the listening environment 101 low frequency sound from 20 Hz to 200 Hz (i.e. a low-frequency range portion of the overall sound output by the audio system). In the audio system 106, each woofer of the plurality of woofers may be assigned its own filter. For example, in the audio system 106, a first finite impulse response FIR filter may be assigned to the first woofer 107, a second finite impulse response FIR filter may be assigned to the second woofer 108, a third finite impulse response FIR filter may be assigned to the third woofer 109, a fourth finite impulse response FIR filter may be assigned to the fourth woofer 110, and a fifth finite impulse response FIR filter may be assigned to the fifth woofer 111.

Overall, the audio system 106 may operate over a frequency range of 20 Hz to 20 KHz. To do so, the audio system 106 may include a plurality of non-woofer transducers, such as mid-frequency transducers and high frequency transducers (e.g., to output low- and mid-frequency range portions of the overall sound output by the audio system, where the overall sound output includes the low- and mid-frequency range portions output by the non-woofer transducers of the audio system and the low-frequency range portions output by the woofers of the audio system). The audio system may include a low frequency crossover. At the low frequency crossover, there may be a seamless transition from the operation of the woofers to the operation of the mid-frequency transducers.

For example, the low frequency crossover may be configured to split an incoming audio signal into multiple frequency ranges (e.g., at least a first frequency range and a second frequency range). A signal corresponding to a first frequency range of the incoming audio signal may be directed to the plurality of woofers in the audio system 106, and a signal corresponding to the second frequency range of the incoming audio signal may be directed to at least one of the one or more mid- and high-frequency transducers. The low frequency crossover may be set within the operation range of the plurality of woofers (i.e., at a point between 20 Hz to 200 Hz). Using the above example, the first frequency range may be within the operation range of the plurality of woofers, and the second frequency range may be within an operation range of at least one of the plurality of non-woofer transducers (e.g., the mid-frequency transducers). The low frequency crossover and/or another crossover circuit may be configured to further split the incoming audio signal and to direct a signal corresponding to a third frequency range of the incoming audio signal to another one or more of the plurality of non-woofer transducers (e.g., the high frequency transducers). In this way, one or more crossovers may be used to split incoming audio and direct different frequency ranges of the incoming audio to associated transducers based on the operating ranges of the transducers.

The audio system 106 may include a user interface. The user interface may be a display. The display may be a touch-screen display. The display may be located in a center-stack of the vehicle 100. Additionally or alternatively, the user interface may include an input hardware element, such as an input switch. The user interface may be electrically connected to a controller of the audio system 106. The controller may include a digital signal processor DSP with a static or adaptive algorithm solution, a graphic processing unit GPU, a system-on-a-chip SOC, and/or another integrated circuit IC. For example, the controller may include frequency impulse response (FIR) control filters and/or adaptive algorithm controls that alter or re-calculate the FIR control filters according to inputs and/or parameters quantified via transducers in or outside of the listening space (e.g., ambient conditions). The controller may be electrically connected to a tuner of the audio system 106, such as an AM tuner or an FM tuner. The controller may be electrically connected to a satellite radio antenna of the audio system 106. The controller may be electrically connected to a wireless antenna of the audio system 106, such as a Bluetooth antenna, a Wi-Fi antenna, or a Wi-Fi Direct antenna. In the audio system 106, the controller may be electrically connected a cellular antenna, a telematics control unit TCU, and/or a GPS antenna. The controller may be electrically connected to a memory device, such as random access memory RAM, read only memory ROM, electrically programmable read only memory EPROM, electrically erasable read only memory EEROM, FLASH, a hard disk drive HDD, and/or a solid state drive SDD, of the audio system 106. Software may be stored in the memory device and accessible and executable by the controller. The filters assigned to the woofers may be stored in the memory device. The controller may be electrically connected to one or more input ports, one or more output ports, and/or one or more input/output I/O ports of the audio system 106. A portable device, such as a smartphone, may communicate with the audio system via the one or more input/output I/O ports, input ports, and/or wireless antenna. The audio system 106 may be electrically connected to a power source, such as a DC battery. The controller may be electrically connected to one or more microphones in the audio system 106. The audio system 106 may include an amplifier. The amplifier may be electrically connected to the controller. The audio system 106 may include analog-to-digital converters ADC, digital-to-analog DAC, additional filters in software, physical hardware filters, additional audio components, and/or additional hardware components.

In the vehicle 100, the listening environment 101 with the plurality of low frequency loudspeakers and appropriate filters may yield a homogeneous low frequency sound field. In the homogeneous low frequency sound field, an occupant may perceive the same low frequency listening experience at each seat in the plurality of seats. As such, if the occupant moves from the first seat 102 to the fourth seat 105, the occupant may perceive the same low frequency listening experience at the fourth seat 105 as he did in the first seat 102. The consistent perception via the homogeneous low frequency sound field may be a desirable user experience, such as for a default low frequency listening experience of the audio system 106. That may be desirable for the occupant can choose any seat without concern as to whether one seat has a better low frequency listening experience than another. As such, because of the homogeneity, the low frequency listening experience is essentially optimized at each seat in the plurality of seats in the listening environment 101 (e.g., a loudness of audio output in the listening environment 101 may be substantially the same at each seat in the plurality of seats in the listening environment, thus the loudness of the audio output in the listening environment may not vary across the listening environment).

In the vehicle 100, the plurality of woofers and the filters assigned thereto may yield the homogeneous low frequency sound field. This may be due to the arrangement of the plurality of woofers in the vehicle 100 and the values set for the filters assigned to the plurality of woofers. To create the homogenous sound field, at least the first woofer 107, the second woofer 108, and the third woofer 109 may be needed. Additionally, the fourth woofer 110 and the fifth woofer 111 may be needed. Moreover, the first finite impulse response FIR filter, the second finite impulse response FIR filter, and the third finite impulse response FIR filter may be needed to create the homogeneous sound field. Additionally, in the vehicle 100, when the fourth woofer and the fifth woofer are included, the fourth finite impulse response FIR filter and the fifth finite impulse response FIR filter may be needed to create the homogeneous sound field.

In the audio system 106, the controller may receive a source signal from an audio source. The audio source may be part of the audio system 106, such as an audio file stored in the memory device of the audio system 106. Alternatively, the audio source may be external to but in communication with the audio system 106, such as a portable device in communication with the audio system via the wireless antenna and having an audio file that may be played-back on the audio system because of the communication therewith. The source signal may be a digital source signal or an analog source signal. When the source signal is the analog source signal, an analog-to-digital converter ADC may convert the analog source signal to a digital source signal. The conversion from analog to digital may occur before reaching the controller or within the controller itself. The latter may occur when the analog-to-digital converter is included in the controller.

The controller may analyze and condition the source signal. As part of the analysis and conditioning, the controller may separate a bass signal from one or more other frequency signals, such as for a stereo left, a stereo right, a center speaker, another speaker in a multichannel system. The bass signal may be a mono signal. The mono signal may be a stereo left signal combined with a stereo right signal. The mono signal may be attributable to a certain frequency range, such as a low frequency range from 20 Hz to 200 Hz.

The controller may send the bass signal (e.g., a low-frequency signal) down the signal path of each woofer in the plurality of woofers. Each signal path includes its own filter. In a signal path, the filter may be the finite impulse response FIR filter assigned to the particular woofer in the plurality of woofers. The finite impulse response FIR filter of the signal path may filter a common bass signal. The filtered bass signal may be sent to a digital-to-analog converter DAC. The filtered bass signal may be converted from digital to analog. The analog filtered bass signal may be amplified in an amplifier. The amplified analog filtered bass signal may drive the particular woofer in the plurality of woofers. In doing so, the particular woofer may output low frequency sound into the listening environment 101.

The controller may send one or more signals covering other parts of the audio spectrum to one or more of the transducers in the plurality of non-woofer transducers. Unlike the bass signals, the one or more other frequency signals may be suited for providing a suitable audio experience by reproducing the whole audible audio spectrum. Therefore, unlike the plurality of woofers, the signals sent from the controller to the plurality of non-woofer transducers may not be the same. For example, if the plurality of non-woofer transducers are setup for 5.1-multichannel surround sound, then, beyond the bass signals, the controller may send out a front left signal, a center signal, a front right signal, a surround left signal, and a surround right signal. The front left signal may be sent to one or more signal paths for a first subset of the non-woofer transducers, the center signal may be sent to one or more signal paths for a second subset of the non-woofer transducers, the front right signal may be sent to one or more signal paths for a third subset of the non-woofer transducers, the surround left may be sent to one or more signal paths for a fourth subset of the non-woofer transducers, and the surround right may be sent to one or more signals for a fifth subset of the non-woofer transducers. Each subset of the non-woofer transducers may be mutually exclusive or independent of one another. Each signal path of the non-woofer transducers may include a filter, a time-delay, a digital-to-analog converter DAC, and an amplifier.

As another example, the non-woofer transducers may be in a stereo setup. In the stereo setup, beyond the homogeneous bass signal, the controller may send out a stereo left signal and a stereo right signal. The stereo left signal may be sent to one or more signal paths for a first subset of the non-woofer transducers, and the stereo right signal may be sent to one or more signal paths for a second subset of the non-woofer transducers. Each subset of the non-woofer transducers may again be mutually exclusive or independent of one another. Other setups outside of the 5.1-multichannel surround sound setup and the stereo setup may be possible for the non-woofer transducers. The sound system in the vehicle 100 (e.g., including woofers 107-111) may provide the homogenous low frequency sound field, a mid-frequency sound field, and/or a high-frequency sound field.

Figure 2:
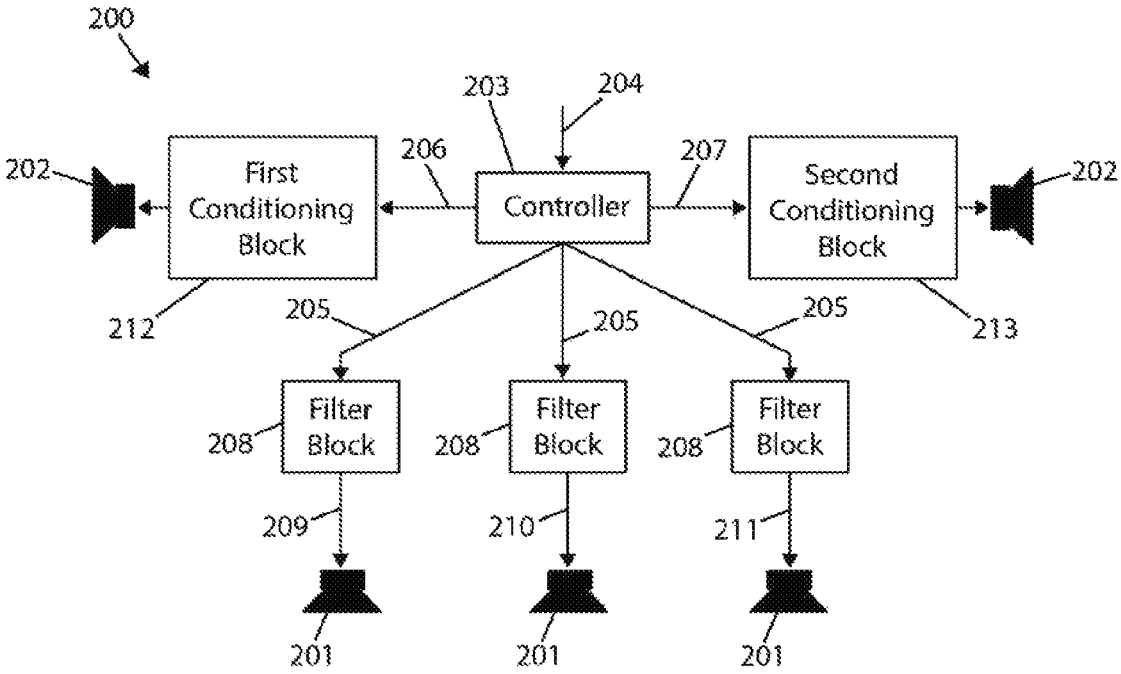
FIG. 2 illustrates a schematic diagram of an audio system according to one or more embodiments.

FIG. 2 illustrates a schematic diagram of an audio system 200 for outputting sound into a listening environment according to one or more embodiments. The listening environment may be a cabin of a vehicle. The audio system 200 may include a plurality of woofers 201. The plurality of woofers 201 may include N+1 woofers, where N≥1. Testing has shown that in certain listening environments, three woofers may be desirable in order to create a homogeneous low frequency sound field. Such may occur when there are packaging and cost constraints. In other listening environments, testing has shown that five woofers may be desirable in order to create a homogeneous low frequency sound field. In other listening environments, though, more or less woofers may be desirable in order to create a homogeneous low frequency sound field. In practice, the number of woofers will be determined by the target low frequency sound field performance desired, such as the desired bandwidth of homogeneity and additional factors such as the cabin geometry and the extent of the listening area in which homogeneity is desired.

The audio system 200 may include a plurality of non-woofer transducers 202. While two are pictured, there may be additional non-woofer transducers in the plurality of non-woofer transducers 202. The non-woofer transducers may differ in make, model, size, and acoustical parameters from one another. Additionally or alternatively, one or more subsets of the plurality of non-woofer transducers 202 may be the same make, model, size, and acoustical parameters.

The audio system may include a controller 203. The controller 203 may receive a source signal 204 from an audio source. The controller 204 may analyze and condition the source signal 204. As part of the analysis and conditioning, the controller may separate bass signals 205 from a first frequency signal 206 and a second frequency signal 207, such as a mid-to-high stereo left signal and a mid-to-high stereo right signal. Beyond the bass signals 205, while two frequency signals 206, 207 are mentioned, there may be additional frequency signals beyond the two frequency signals. Alternatively, instead of two frequency signals 206, 207, there may only be one frequency signal. As such, the first frequency signal 206 may be the same or differ from the second frequency signal 207.

From the controller 204, each signal path of the plurality of woofers 201 may receive the same bass signal 205. Each signal path of the plurality of woofers may include its own filter block 208. Each filter block 208 may include a filter. In each filter block 208 the filter may be a finite impulse response FIR filter. The values for each of the FIR filters may differ from one another. Alternatively, two or more FIR filters may have the same value settings. The bass signals 205 may, therefore, be filtered according to the filter of the filter block in its respective signal path. Therefore, when the filters are FIR filters having different values from one another, the filtered bass signals will differ from one another.

Each filter block 208 may include a digital-to-analog converter DAC and an amplifier. The filtered bass signal of a respective signal path may be converted from digital to analog via the digital-to-analog converter DAC and thereafter be amplified by the amplifier. Each amplified analog filtered bass signal 209, 210, 211 may be supplied to its respective woofer in the plurality of woofers 201. Each amplified analog filtered bass signal 209, 210, 211 may be different from one another. Alternatively, one or more of the amplified analog filtered bass signals 209, 210, 211 may be identical. In response, each woofer in the plurality of woofers 201 may accordingly output low frequency sound into the listening environment.

The distribution and orientation of the plurality of woofers 201 in or around the listening environment may by passive means and without additional filtering, yield a suitably homogeneous low frequency sound field. At times, the combination of the distribution and orientation of the plurality of woofers 201 and the filters in the filtering blocks 208 may achieve the homogeneous low frequency sound field. In such scenarios, the filters in the filter blocks may be tuned to achieve the homogeneous low frequency sound field.

From the controller 203, the first audio signal may pass through a first conditioning block 212. The first conditioning block may include a filter, a converter, an amplifier, or another signal conditioning element. From the first conditioning block, the first audio signal is conditioned to be passed directly to its respective non-woofer transducer(s) of the plurality of non-woofer transducer 202. In response, the respective non-woofer transducer(s) output mid-to-high-frequency sound into the listening environment (e.g., higher frequency sound than that which is output by the woofers). Similarly, from the controller 203, the second audio signal may pass through a second conditioning block 213. The second conditioning block may include a filter, a converter, an amplifier, or another signal conditioning element. From the second conditioning block, the second audio signal is conditioned to be passed directly to its respective non-woofer transducers of the plurality of non-woofer transducers 202. In response, the respective non-woofer transducer (s) output mid-to-high-frequency sound into the listening environment.

Figure 3:
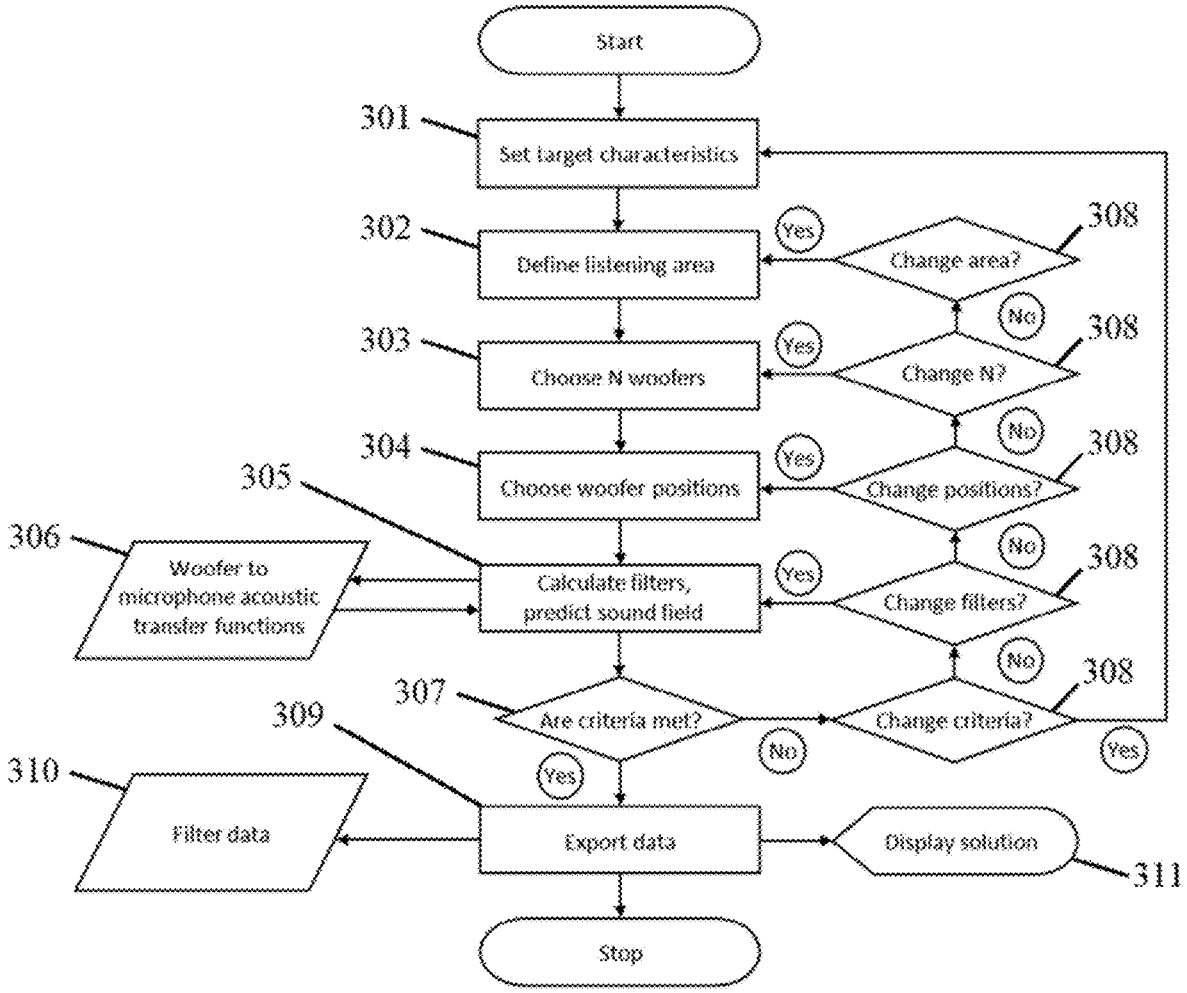
FIG. 3 illustrates a flowchart diagram that describes a typical workflow when optimizing the low frequency sound field.

FIG. 3 illustrates a flowchart diagram that describes a typical workflow when optimizing the low frequency sound field. The steps in the flowchart can be manual or more or less automated as desired and the steps in the workflow can follow a different order. Initially, the desired target low frequency sound field characteristics are specified at 301. This specification includes one or more parameters that describe the desired low frequency sound field which could be, but are not limited to, the desired bandwidth of the low frequency sound, such as 20-200 Hz, and/or the standard deviation of the sound pressure level values at discrete points in space within the low frequency sound field across a range of frequencies covering the desired operating bandwidth. The listening area is defined as a spatial region at 302, relevant for the listening environment 101, such as 400 shown in FIG. 4. A plurality of woofers 201 is then chosen at 303 and may include N+1 woofers, where N≥1. For the plurality of woofers, a position is chosen at 304 for each woofer in relation to the vehicle 100 and its listening environment 101.

The low frequency control filters can now be calculated at 305. For the calculation of the filters a database may be accessed at 306, the database including the associated acoustical transfer functions, such as impulse responses or frequency responses of the transfer path, between the plurality of woofers selected at 303 and the discrete points in space within the defined listening area set at 302. The discrete points could be a 3-dimensional grid with a spacing of, but not limited to, 5 cm. This spacing can be coarser depending on the upper limiting frequency of the sound field under analysis. The database of transfer functions may have been gained by measurement within a real listening environment or vehicle with real woofers and microphones, but the transfer functions can also be obtained from a virtual simulation model of the listening environment or vehicle using virtual woofers and virtual microphones. Such a virtual model may be a finite element model.

FIR filters (e.g., filters 208 of FIG. 2) may be applied to the low frequency signal (e.g., signal 205 of FIG. 2) and fed to the plurality of woofers (e.g., woofers 201 of FIG. 2). The control filters are determined/calculated based on optimization approach, seeking to achieve a given target which is defined in a cost function. The assessment (through manual/automated iterative approach according to FIG. 3) is done mathematically by convolving the transfer functions from woofer to microphones with the filter responses and thus the optimization predicts the resulting low frequency sound field. An optimization routine may be based on a Least Mean Square algorithm or similar. Subsequently, the specification criteria, such as, but not limited to, the standard deviation in the sound pressure level, from the resulting low frequency sound field can be derived at frequencies over the desired bandwidth of the low frequency sound field.

Should the criteria for the desired low frequency sound field not be met (e.g., "No" at 307), a number of decisions 308 can be made to modify the start conditions for the optimization. When met, the resulting FIR filters (e.g., filters 208 of FIG. 2) calculated can be exported at 309. The data 310 can be stored in a data format suitable for implementation of the filters and also displayed 311 such as in the data presented in FIGS. 6, 7, and 8.

Figure 4:
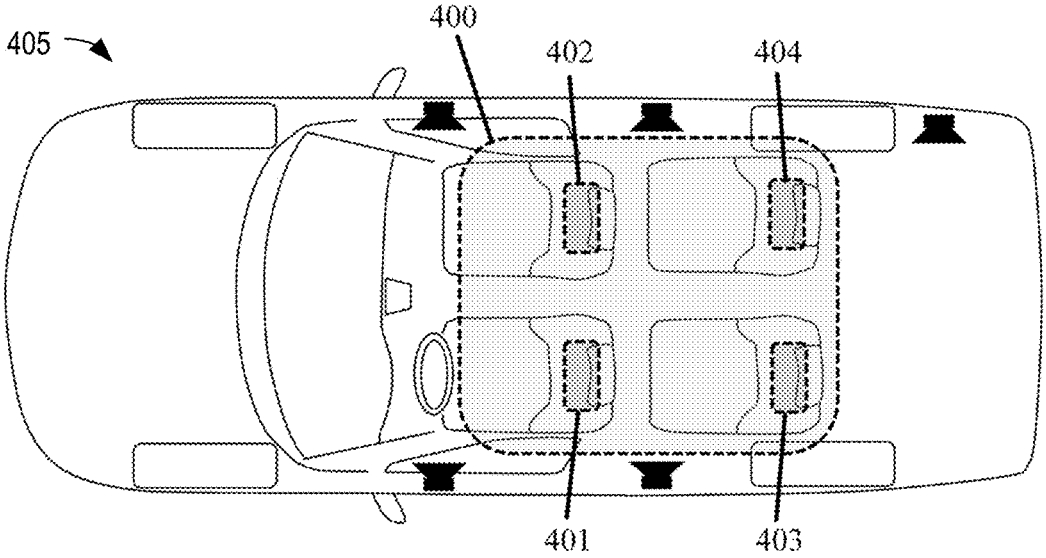
FIG. 4 illustrates a schematic diagram of a vehicle according to one or more embodiments including the listening area around each passenger head position and a wider listening area covering a range of seat positions.

FIG. 4 illustrates a schematic diagram of a vehicle 405 according to one or more embodiments including the listening area around each passenger head position 401, 402, 403, and 404 for the seats FL, FR, RL, and RR as described in FIG. 1 respectively, and a wider listening area 400 covering a range of seat positions which may include all seat positions or multiple subsets of groups of seats. The listening areas illustrated represent a range of nominal ear positions for the passengers including their nominal range of heights. The low frequency sound field in the listening areas is driven by the plurality of woofers as described in FIG. 1.

Figure 5:
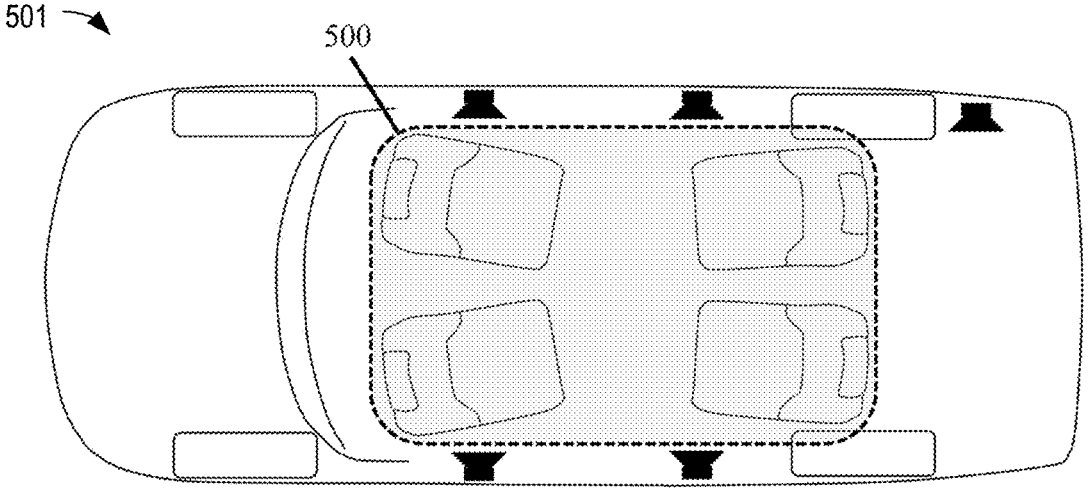
FIG. 5 illustrates again a wider listening area as FIG. 4 but in the case of an autonomous vehicle or similar where the seating positions may be even more flexible and passengers free from the task of driving the vehicle.

FIG. 5 illustrates again a wider listening area 500 as 400 in FIG. 4 but in the case of an autonomous vehicle 501 or similar where the seating positions may be even more flexible and the passengers are free from the task of driving the vehicle such that they may face in a different direction than the direction of travel. 500 may include all seat positions or multiple subsets of groups of seats. The low frequency sound field in the listening areas is driven by the plurality of woofers as described in FIG. 1.

Figure 6:
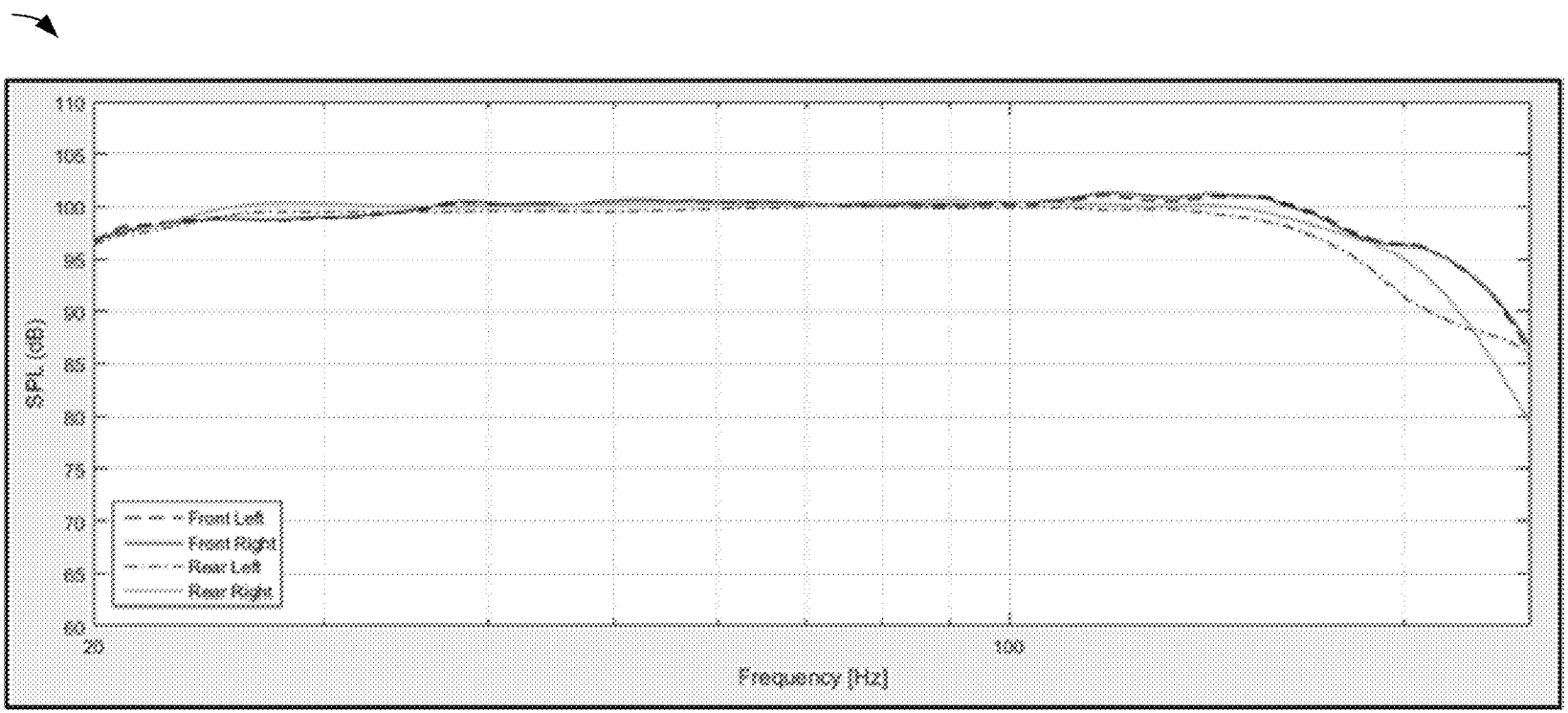
FIG. 6 illustrates an example of the sound system responses in each of the areas that represent each passenger head position as shown in FIG. 4 when the low frequency sound field in controlled such that each position achieves a similar sound pressure response.

FIG. 6 illustrates an example plot 600 of the sound system responses in each of the areas that represent each passenger head position as shown in FIG. 4 when the low frequency sound field in the listening areas is driven by the plurality of woofers as described in FIG. 1 and is controlled such that each position achieves a homogeneous sound pressure.

Figure 7:
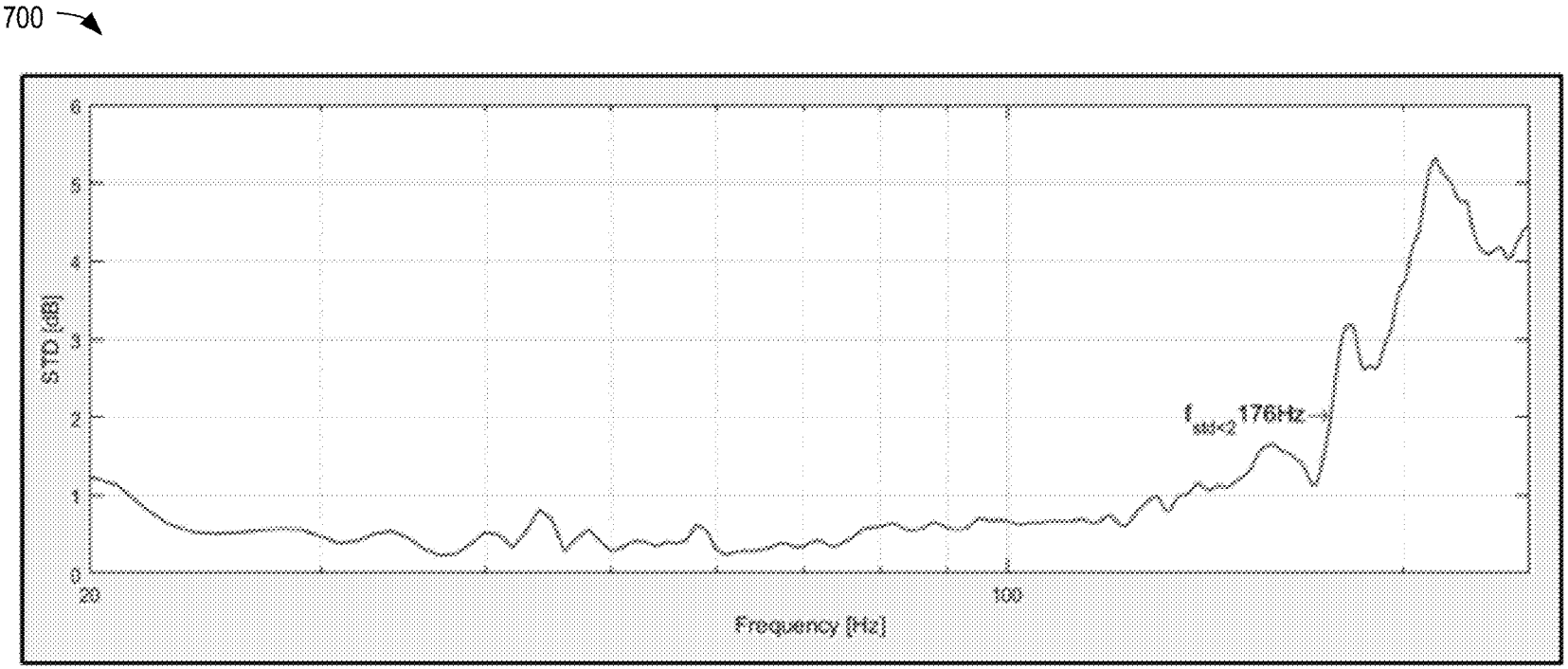
FIG. 7 illustrates the related standard deviation in the sound pressure level calculated in the whole of the wider listening area illustrated in FIG. 4 for the controlled low frequency sound field in FIG. 6.

FIG. 7 illustrates a plot 700 of the related standard deviation of the sound pressure level calculated in the whole of the wider listening area 400 illustrated in FIG. 4 for the controlled low frequency sound field in FIG. 6. In this example, the standard deviation is below 2 below 176 Hz meaning that 68% of the responses lie within +/−2 dB of the mean for a normally distributed dataset.

Figure 8:
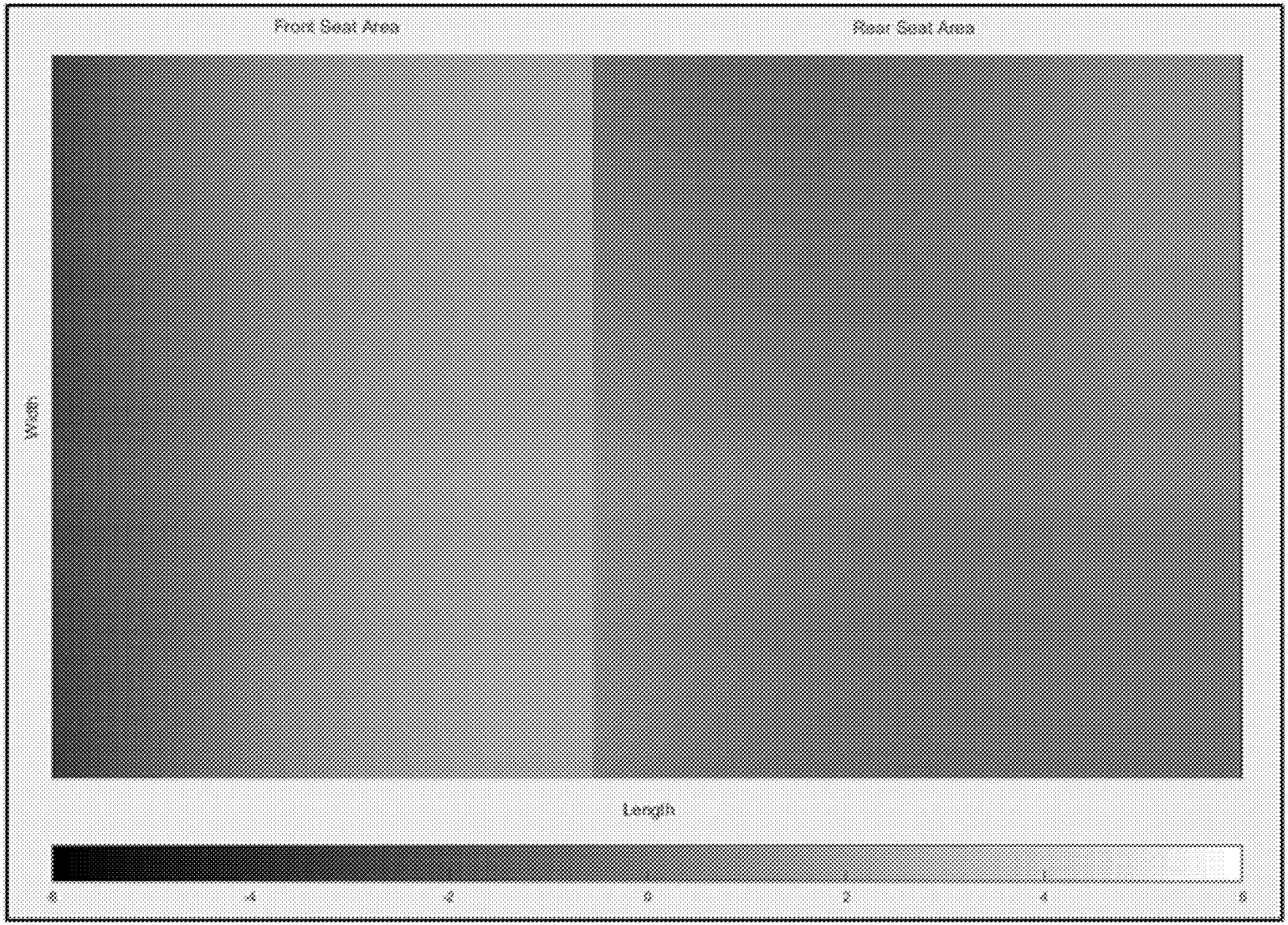
FIG. 8 illustrates a surface plot at 150 Hz for the difference in sound pressure level in dB relative to the mean sound pressure level calculated across the whole of the wider listening area illustrated in FIG. 4 for the controlled low frequency sound field as also described by FIG. 6 and FIG. 7.

FIG. 8 illustrates a surface plot 800 at 150 Hz for the difference to the mean sound pressure level throughout the wider listening area 400 illustrated in FIG. 4 for the controlled low frequency sound field as also described by FIG. 6 and FIG. 7. The grey scale illustrates the deviation in dB from the mean sound pressure level in the wider listening area 400 in FIG. 4 which shows low deviation when the sound field is controlled.

Figure 9:
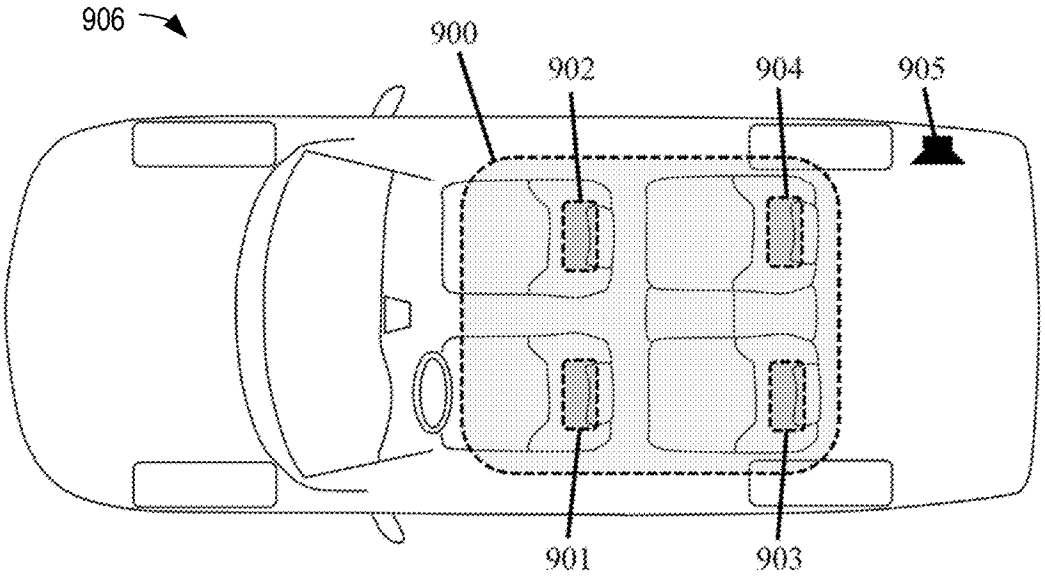
FIG. 9 illustrates a schematic diagram of a vehicle where only a single woofer or subwoofer is active and includes the listening area around each passenger head position and a wider listening area covering a range of seat positions.

FIG. 9 illustrates a schematic diagram of a vehicle 906 where only a single woofer or subwoofer 905 is active and includes the listening area around each passenger head position 901, 902, 903, 904 for the seats FL, FR, RL, RR as described in FIG. 1 respectively, and a wider listening area 900 covering a range of seat positions. In this example, the single woofer or subwoofer 905 is placed in the trunk corner area as illustrated.

Figure 10:
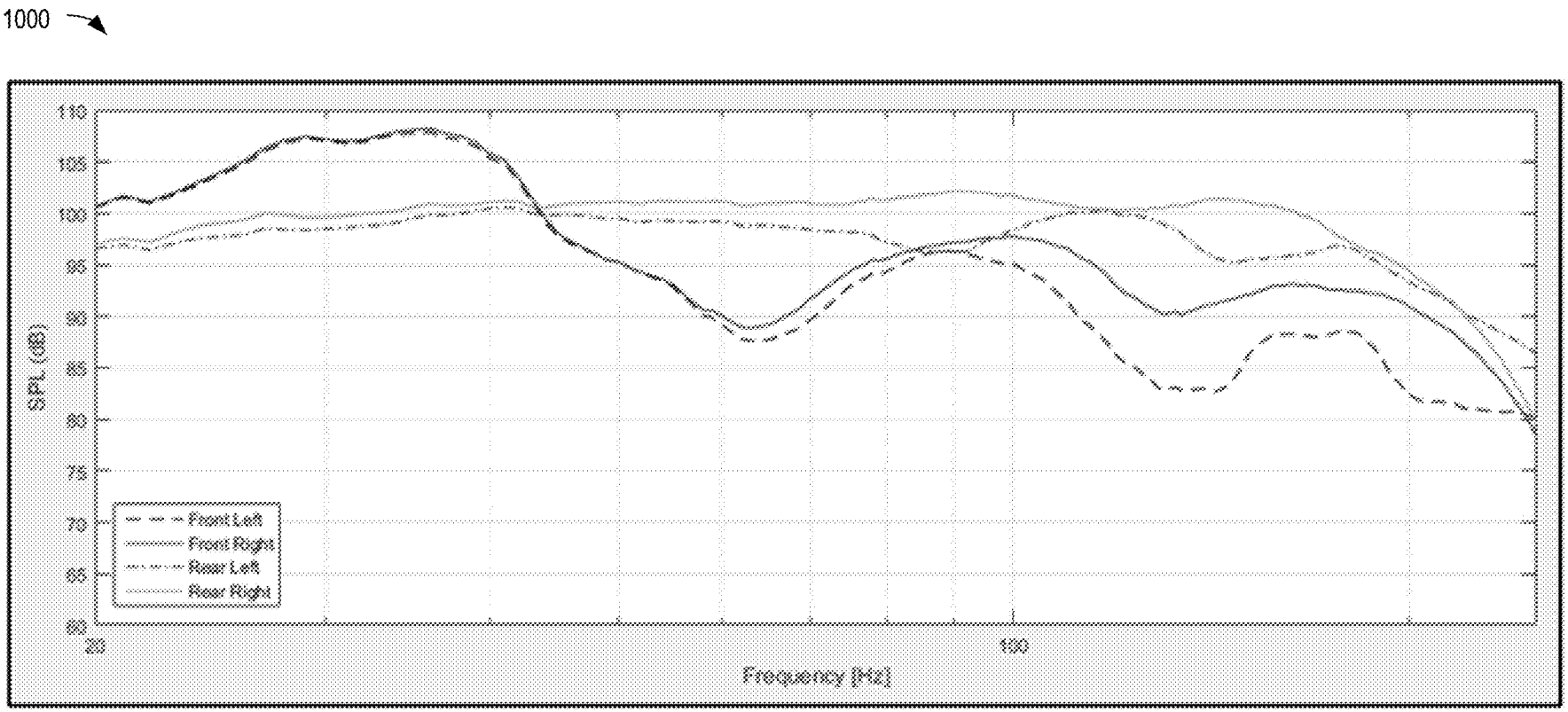
FIG. 10 illustrates the resulting sound pressure level responses in each of the areas that represent each passenger head position as shown in FIG. 9 in a typical vehicle when only the single woofer or subwoofer is active.

FIG. 10 illustrates a plot 1000 of the resulting sound pressure level responses in each of the areas that represent each passenger head position as described in FIG. 9 in a typical vehicle when only the single woofer or subwoofer 905 is driving the low frequency sound field in the listening areas. In this example, the single woofer or subwoofer 905 is placed in the trunk corner area as illustrated in FIG. 9 and a global tuning of the sound system attempts to achieve a smooth frequency response in the rear seats.

Figure 11:
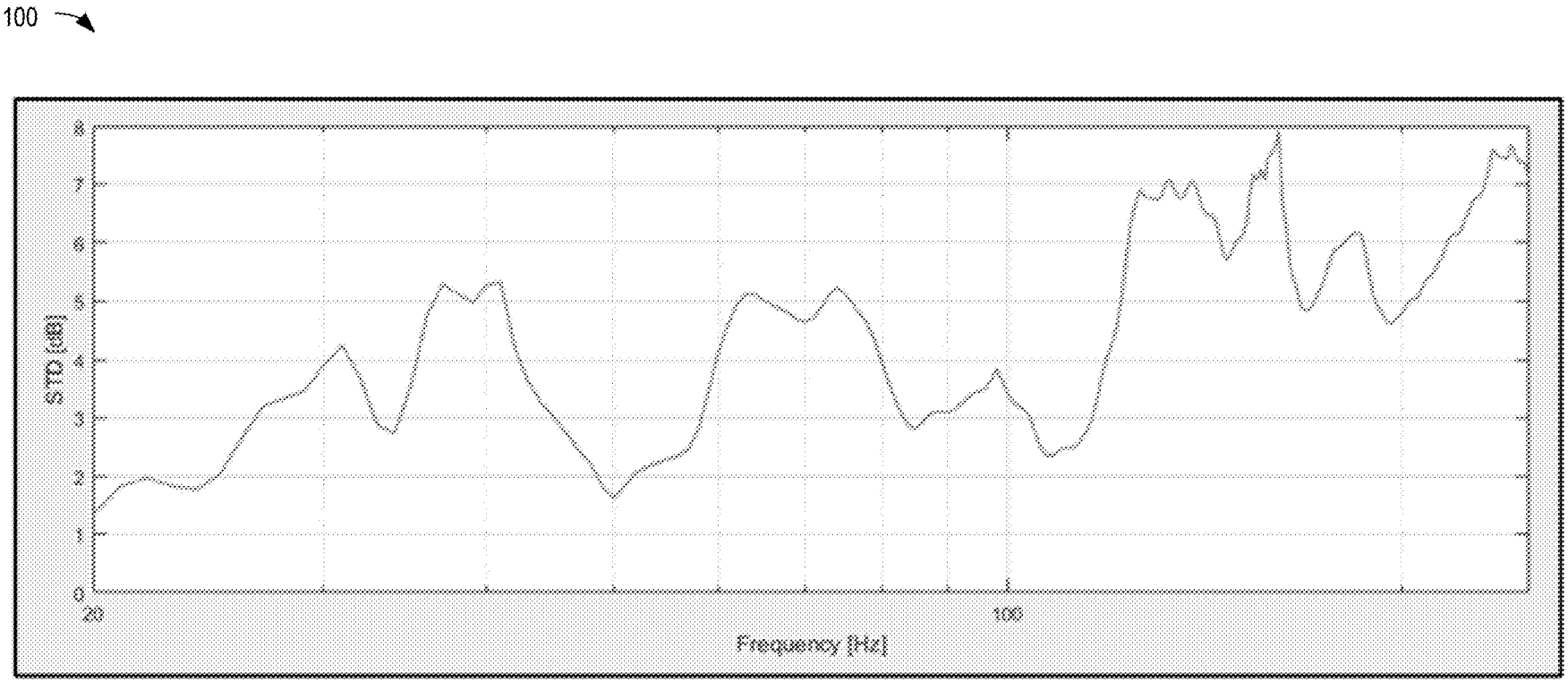
FIG. 11 illustrates the resulting standard deviation in the sound pressure level calculated in the whole of the wider listening area illustrated in FIG. 9 in a typical vehicle when only the single woofer or subwoofer is active.

FIG. 11 illustrates a plot 1100 of the resulting standard deviation in the sound pressure level calculated in the whole of the wider listening area 900 illustrated in FIG. 9 in a typical vehicle when only the single woofer or subwoofer 905 is driving the low frequency sound field in the listening areas. In this example, the single woofer or subwoofer 905 is placed in the trunk corner area as illustrated in FIG. 9 and a global tuning of the sound system attempts to achieve a smooth frequency response in the rear seats.

Figure 12:
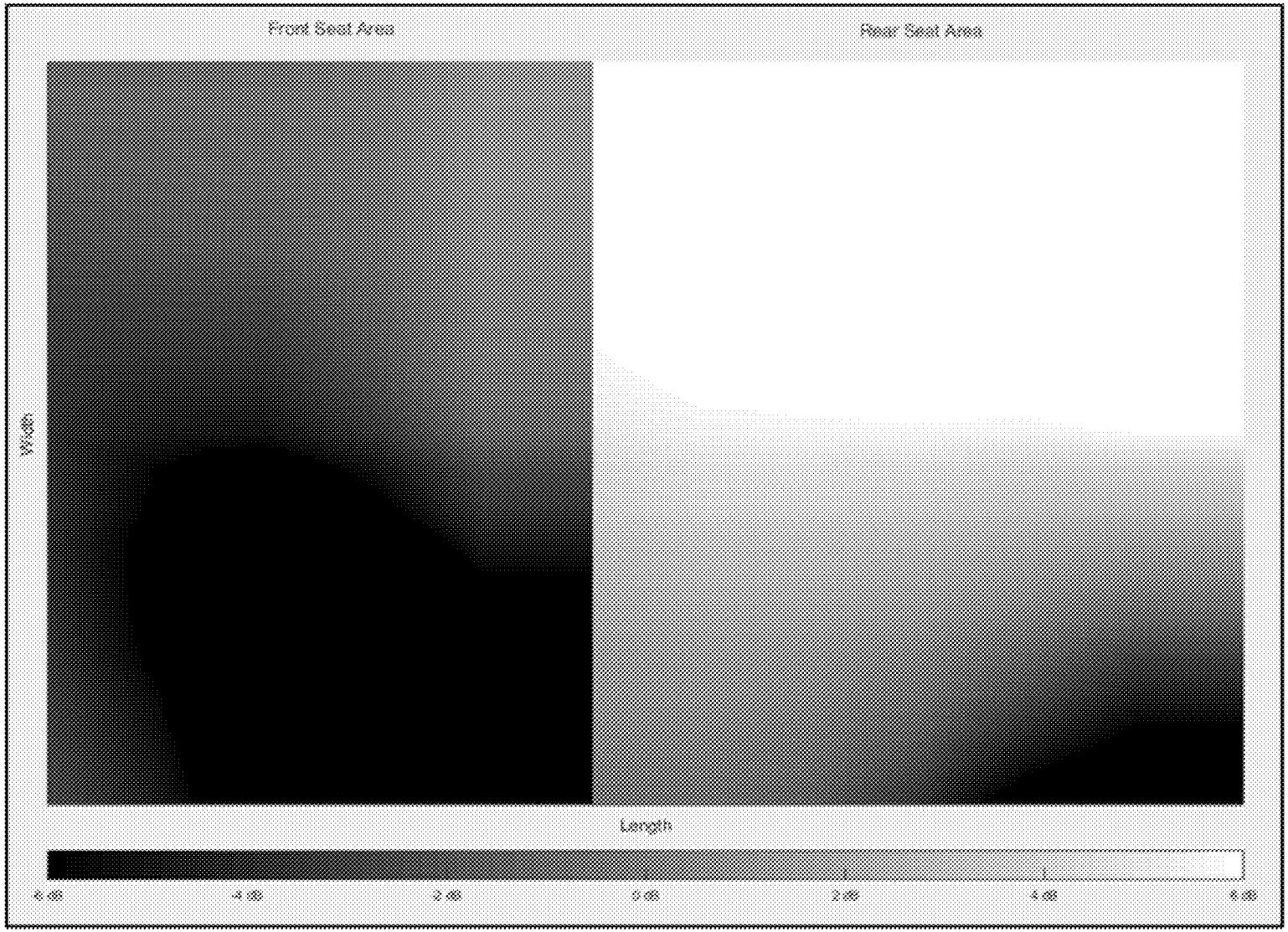
FIG. 12 illustrates a surface plot at 150 Hz for the difference in sound pressure level in dB relative to the mean sound pressure level calculated across the whole of the wider listening area illustrated in FIG. 9 in a typical vehicle when only the single woofer or subwoofer is active.

FIG. 12 illustrates a surface plot 1200 at 150 Hz for the difference to the mean sound pressure level throughout the wider listening area 900 illustrated in FIG. 9 in a typical sport utility vehicle (SUV) when only the single woofer or subwoofer 905 is driving the low frequency sound field in the listening areas. For example, a listener in the rear seat area may experience substantially higher sound pressure levels than the front seat area, such as at 150 Hz where the rear right seat area 904 in FIG. 9 a listener experiences a significantly higher sound pressure level than the other seats, in particular a sound pressure level 12 dB higher than the front left seat area 901 in FIG. 9. In this example, the single woofer or subwoofer 905 is placed in the trunk corner area as illustrated in FIG. 9. The grey scale illustrates the deviation in dB from the mean sound pressure level in the wider listening area 900 in FIG. 9.

Figure 13:
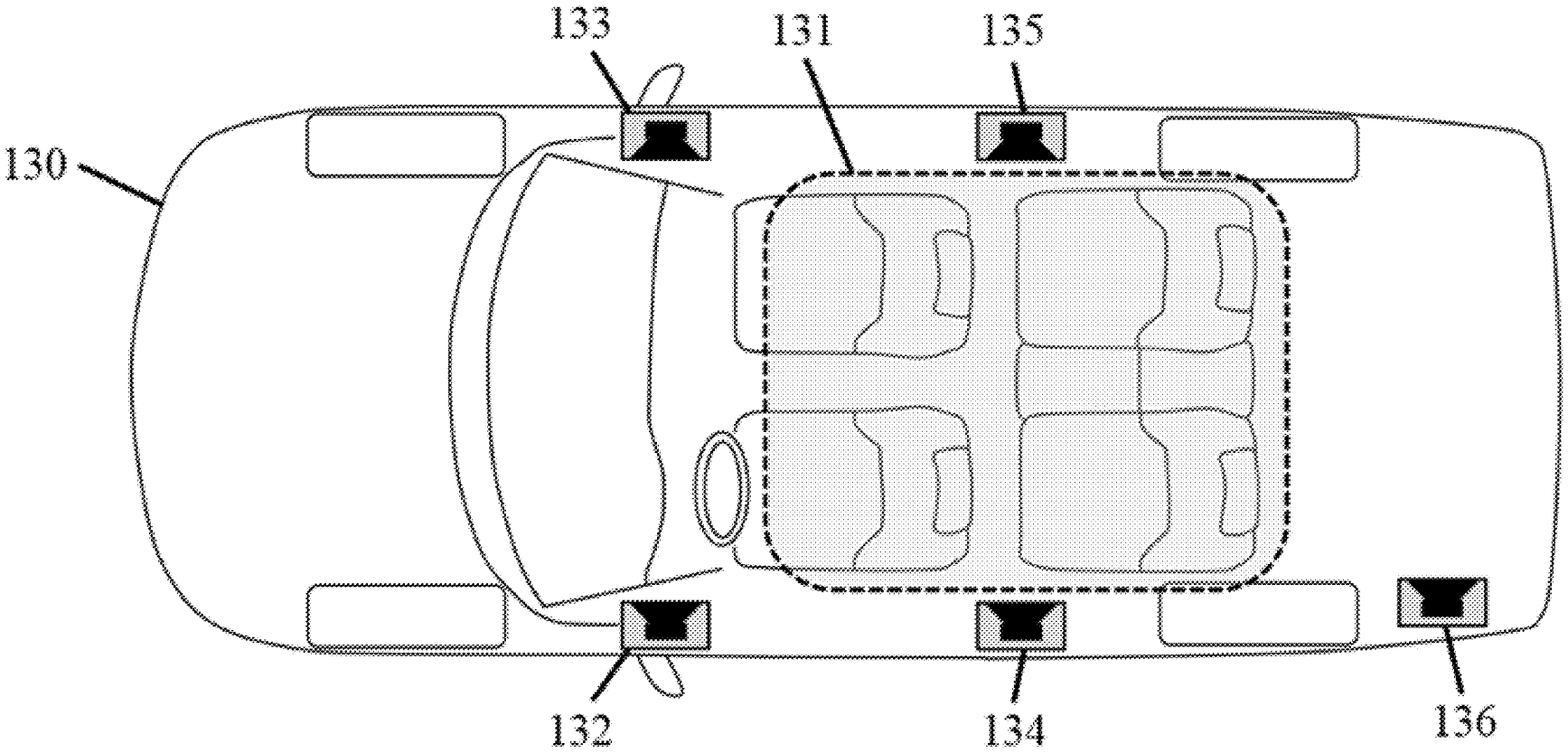
FIG. 13 illustrates an embodiment of the disclosure for a larger vehicle cabin.

FIG. 13 illustrates an example embodiment for a larger vehicle cabin 130 such as, but not limited to, an SUV type cabin. The listening area 131 covers the required listening area and may include a third row of seats. The example embodiment includes five equal woofers 132, 133, 134, 135, and 136 where the front woofers 132 and 133 are located under the A-pillar area on opposite sides of the vehicle. Two woofers 134 and 135 are located on opposite sides of the vehicle such as in the rear door trim panels in the middle of the cabin area. The fifth woofer 136 is located on the side of the trunk area at a height above the trunk floor surface. The woofers in this embodiment may have a chassis diameter of 170 mm and a radiating area of 154 $cm^2$ in one illustrative example. The sound radiating area (front side) of all woofers radiates into the passenger area of the cabin. In this embodiment it is seen that the woofers are spatially distributed within the vehicle cabin. All five woofers 132, 133, 134, 135, and 136 are each mounted in 12 liter sealed enclosures such that the rear sound radiation from the back side of the woofer membrane is isolated from the passenger area of the cabin and furthermore, significantly reduces leakage of low frequency audio to the outside of the vehicle.

Figure 14:
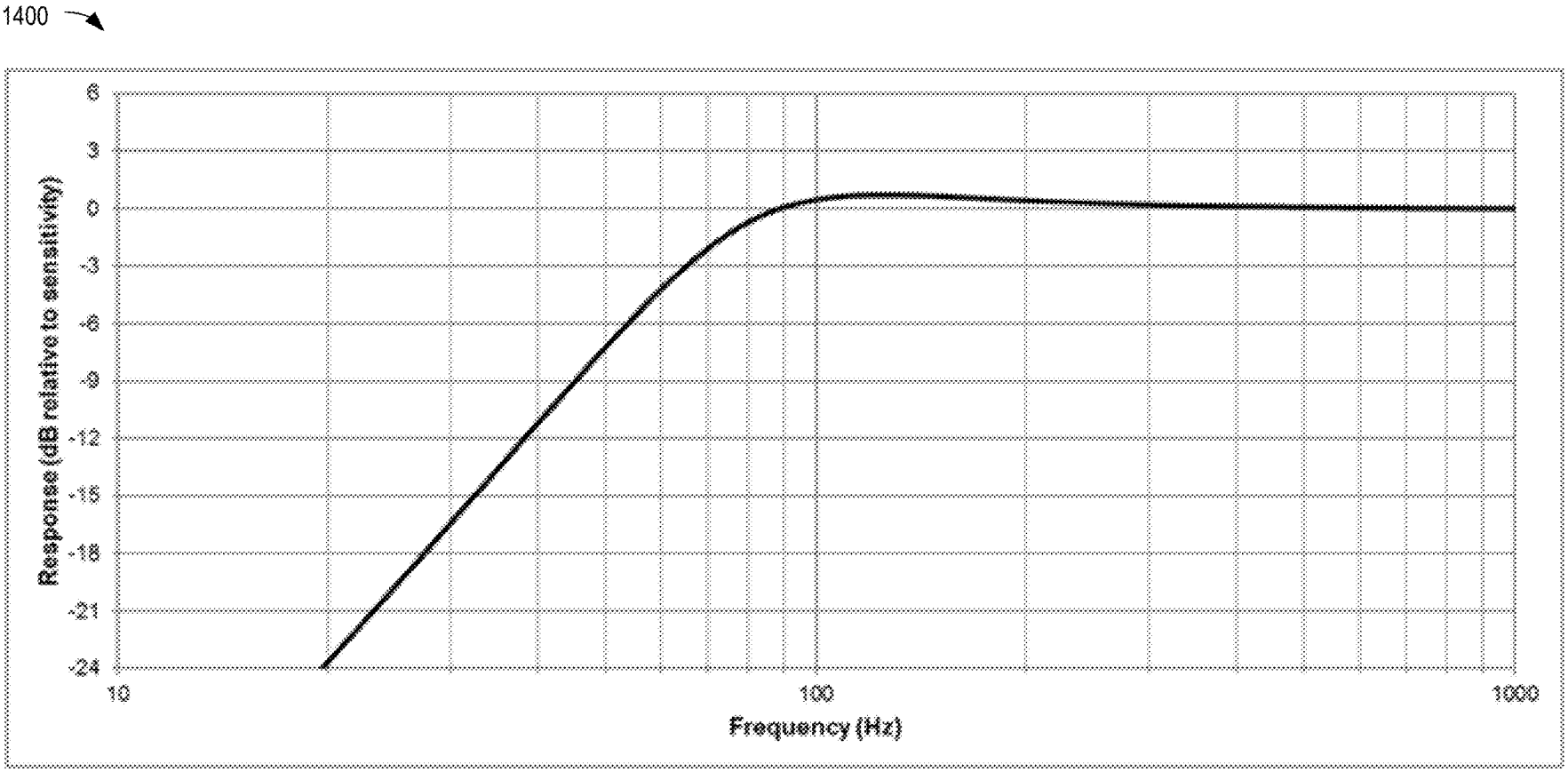
FIG. 14 illustrates the infinite baffle response of a woofer loudspeaker wherein the woofer has a sealed rear enclosure as it is deployed in the embodiment of the disclosure as shown in FIG. 13.

FIG. 14 illustrates a plot 1400 of the infinite baffle response of one of the woofers from the embodiment shown in FIG. 13 when the woofer has a sealed rear enclosure of 12 liters. The volume of the enclosure can beneficially be filled with suitable acoustic damping material. The infinite baffle response shown in FIG. 14, which is a second order high pass function, can be described by a Q-factor of 0.9 and a resonance frequency of 80 Hz in this embodiment.

Figure 15:
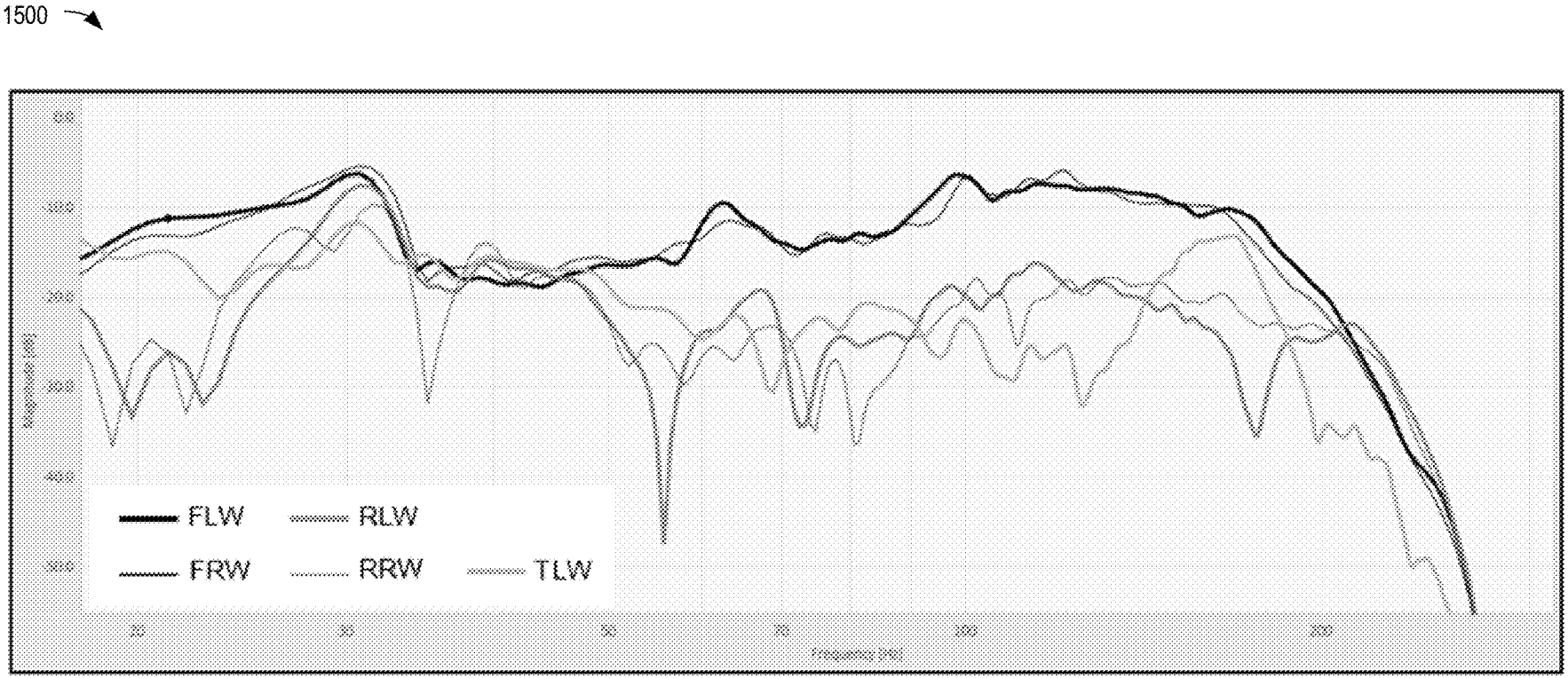
FIG. 15 illustrates the controlling filter magnitude responses for each of the five woofers deployed in the embodiment of the disclosure as shown in FIG. 13.

FIG. 15 illustrates a plot 1500 of the controlling filter 208 in FIG. 2 magnitude responses for each of the five woofers deployed in the embodiment of the disclosure as shown in FIG. 13. The legend refers to the woofer locations described in FIG. 13 where front left woofer FLW is 132, front right woofer is 133, rear left woofer RLW is 134, rear right woofer RRW is 135 and trunk left woofer TLW is 136. Implementation of the controlling filters in the example embodiment will result in a homogeneous low frequency sound field as described in FIGS. 6, 7, and 8.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices, such as the controller 203 and the speakers 201/202 of FIG. 2. The methods may be performed by executing stored instructions with one or more logic devices (e.g., processors) in combination with one or more additional hardware elements, such as storage devices, memory, hardware network interfaces/antennas, switches, actuators, clock circuits, etc. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

While exemplary embodiments are described above, it is not intended that these embodiments describe all possible forms of the disclosed features. Rather, the words used in the specification are words of description rather than limitation, and it is understood that various changes may be made without departing from the spirit and scope of the disclosure. Additionally, the features of various implementing embodiments may be combined to form further embodiments of the disclosure.

The invention claimed is:

1. An audio system, comprising:

a plurality of low frequency loudspeakers configured to output low frequency sound into a listening environment; and a plurality of filters, each of the plurality of low frequency loudspeakers having a respective filter of the plurality of filters assigned thereto to yield a homogeneous low frequency sound field, the homogeneous low frequency sound field comprising homogenizing a low frequency listening experience for users in a plurality of locations in the listening environment, wherein the listening environment comprises a number of seats, the plurality of low frequency loudspeakers includes a quantity of low frequency loudspeakers that is based on the number of seats, and each of the low frequency loudspeakers is mounted in a sealed enclosure such that rear sound radiation from a back side of the low frequency loudspeaker is isolated from users in the plurality of locations in the listening environment and so as to reduce leakage of low frequency audio to outside of the listening environment.

2. The audio system of claim 1, wherein in the homogeneous low frequency sound field, the low frequency listening experience at each of the plurality of locations in the listening environment is the same as one another.

3. The audio system of claim 2, wherein the listening environment is within a vehicle and wherein the plurality of locations in the listening environment include different seats within the vehicle.

4. The audio system of claim 1, wherein the plurality of filters includes finite impulse response filters tuned to achieve the homogeneous low frequency sound field.

5. The audio system of claim 1, further comprising one or more mid- and high-frequency transducers configured to output mid- and high-frequency portions of an overall sound output by the audio system, the overall sound including the mid- and high-frequency portions output by the mid- and high-frequency transducers and low-frequency portions output by a plurality of woofers.

6. The audio system of claim 5, further comprising a low frequency crossover configured to split an incoming audio signal into at least a first frequency range and a second frequency range, a signal corresponding to the first frequency range of the incoming audio signal being directed to the plurality of woofers and a signal corresponding to the second frequency range of the incoming audio signal being directed to at least one of the one or more mid- and high-frequency transducers.

7. The audio system of claim 5, wherein the plurality of woofers includes three woofers.

8. The audio system of claim 5, wherein the plurality of woofers includes five woofers.

9. The audio system of claim 5, wherein the listening environment is within a vehicle and wherein the plurality of woofers includes a quantity of woofers that is based on a number of seats in the vehicle.

10. The audio system of claim 1, further comprising a controller, the controller configured to:

receive a source signal from an audio source, analyze and condition the source signal to produce a conditioned source signal, and transmit at least a portion of the conditioned source signal to a plurality of woofers, each signal path between the controller and the plurality of woofers receiving a same bass signal.

11. The audio system of claim 10, wherein each signal path between the controller and each woofer of the plurality of woofers includes a respective filter block, each filter block including a respective filter of the plurality of filters configured to filter the bass signal transmitted on the associated signal path to produce a filtered homogeneous bass signal.

12. The audio system of claim 11, where the respective filter of each filter block is set independent of each other filter of each other filter block.

13. The audio system of claim 11, wherein each filter block includes a digital-to-analog converter and an amplifier, the filtered homogeneous bass signal for each signal path being converted by the respective digital-to-analog converter for that signal path, then amplified by the respective amplifier for that signal path, then supplied to the respective woofer for that signal path to be output as low frequency sound to form the homogeneous low frequency sound field.

14. A method for producing a homogeneous low frequency sound field via a plurality of woofers of an audio system, the method comprising:

setting, with a processor of the audio system, characteristics of a target low frequency sound field performance for the homogeneous low frequency sound field, the homogeneous low frequency sound field comprising homogenizing a low frequency listening experience for users in a plurality of locations in a listening environment, wherein the listening environment comprises a number of seats, and the plurality of woofers includes a quantity of woofers that is based on the number of seats;

defining, with the processor, a listening area for the homogeneous low frequency sound field;

selecting, with the processor, the plurality of woofers to output the homogeneous low frequency sound field, each of the plurality of woofers having a respective position specified relative to an environment including the listening area;

calculating, with the processor, one or more filters for achieving the homogeneous low frequency sound field;

applying the one or more filters to a low frequency signal supplied to the plurality of woofers, the one or more filters being tuned based on the characteristics of the target low frequency sound field performance for the homogeneous low frequency sound field; and outputting, via the plurality of woofers, the homogeneous low frequency sound field, wherein each of the low frequency loudspeakers is mounted in a sealed enclosure such that rear sound radiation from a back side of the low frequency loudspeaker is isolated from users in the plurality of locations in the listening environment and so as to reduce leakage of low frequency audio to outside of the listening environment.

15. The method of claim 14, wherein the target low frequency sound field performance is set responsive to user input received via a user interface of the audio system, the user input specifying one or more target parameters for the homogeneous low frequency sound field, the one or more target parameters including a target bandwidth of the homogeneous low frequency sound field and/or a target standard deviation of sound pressure level values at discrete points within the low frequency sound field across a range of discrete frequencies covering the target bandwidth.

16. The method of claim 14, wherein the listening area is defined using positioning information received via user input to a user interface of the audio system.

17. The method of claim 14, wherein calculating the one or more filters for achieving the homogeneous low frequency sound field includes retrieving, with the processor, from a database, acoustical transfer functions between the plurality of woofers and different discrete points within the listening area.

18. An audio system for a vehicle, the audio system comprising:

a plurality of woofers;

one or more non-woofer transducers;

a low frequency crossover; and a controller configured to:

receive target parameters for a homogeneous low frequency sound field, the homogeneous low frequency sound field for homogenizing a low frequency listening experience for users in a plurality of locations in a listening area, the homogeneous low frequency sound field comprising homogenizing the low frequency listening experience for users in the plurality of locations in the listening area, wherein the listening area comprises a number of seats, and the plurality of woofers includes a quantity of woofers that is based on the number of seats, define the listening area for the homogeneous low frequency sound field within the vehicle, calculate one or more filters for achieving the homogeneous low frequency sound field based on the received target parameters and the defined listening area, receive an audio signal from an audio source, direct the audio signal to the low frequency crossover, the low frequency crossover configured to split the audio signal into a first signal corresponding to a first frequency range of the audio signal and a second signal corresponding to a second frequency range of the audio signal, the first frequency range being lower than the second frequency range, direct the first signal to each of the plurality of woofers and the second signal to at least one transducer of one or more non-woofer transducers, for each woofer, apply a respective filter of the one or more filters to the first signal to generate a respective filtered signal, the respective filter being tuned based on the target parameters for the homogeneous low frequency sound field, and output, via the plurality of woofers, each respective filtered signal to generate the homogeneous low frequency sound field, wherein each of the low frequency loudspeakers is mounted in a sealed enclosure such that rear sound radiation from a back side of the low frequency loudspeaker is isolated from users in the plurality of locations in the listening environment and so as to reduce leakage of low frequency audio to outside of the listening environment.

19. The audio system of claim 18, wherein the controller is further configured to output, via the at least one transducer, the second signal to generate a mid- or high-frequency sound field.

20. The audio system of claim 18, wherein calculating the one or more filters for achieving the homogeneous low frequency sound field includes retrieving, with the controller, from a database, acoustical transfer functions between the plurality of woofers and different discrete points within the listening area of the vehicle.

* * * * *